US011694583B2

(12) United States Patent
Crawley

(10) Patent No.: US 11,694,583 B2
(45) Date of Patent: Jul. 4, 2023

(54) SIGN KIT FOR A BARRIER POST

(71) Applicant: Tensator Group Ltd, Milton Keynes (GB)

(72) Inventor: Peter James Crawley, Milton Keynes (GB)

(73) Assignee: TENSATOR GROUP LTD

( * ) Notice: Subject to any disclaimer, the term of this patent is extended or adjusted under 35 U.S.C. 154(b) by 0 days.

(21) Appl. No.: 17/331,755

(22) Filed: May 27, 2021

(65) Prior Publication Data

US 2021/0375163 A1 Dec. 2, 2021

(30) Foreign Application Priority Data

May 29, 2020 (GB) ..... 2008100

(51) Int. Cl.

| | |
|---|---|
| ***G09F 7/18*** | (2006.01) |
| ***G09F 1/06*** | (2006.01) |
| ***G09F 1/10*** | (2006.01) |

(52) U.S. Cl.

CPC ..... *G09F 7/18* (2013.01); *G09F 1/06* (2013.01); *G09F 1/10* (2013.01); *G09F 2007/1821* (2013.01)

(58) Field of Classification Search

CPC ..... E01F 13/028; E01F 13/02; G09F 1/065; G09F 2007/1821; G09F 1/06; G09F 7/18

See application file for complete search history.

(56) References Cited

U.S. PATENT DOCUMENTS

| | | | | |
|---|---|---|---|---|
| 2009/0119956 | A1* | 5/2009 | Martin Presa | G09F 1/065 40/1 |
| 2009/0146123 | A1* | 6/2009 | Hewitt | E01F 7/02 256/45 |
| 2009/0226252 | A1* | 9/2009 | Field | E01F 13/028 404/6 |
| 2009/0230266 | A1* | 9/2009 | Hillstrom | F16M 13/022 248/219.4 |

(Continued)

FOREIGN PATENT DOCUMENTS

| | | |
|---|---|---|
| DE | 10 2018 132 494 A1 | 6/2020 |
| EP | 1 331 313 A1 | 7/2003 |
| EP | 3 264 398 A1 | 1/2018 |

OTHER PUBLICATIONS

Combined Search and Examination Report dated Nov. 10, 2020 in corresponding United Kingdom Patent Application No. GB2008100.6.

*Primary Examiner* — David R Dunn
*Assistant Examiner* — Christopher E Veraa
(74) *Attorney, Agent, or Firm* — Ostrolenk Faber LLP

(57) ABSTRACT

A simple sign kit for mounting on top of a barrier post that has only two sheets of flexible material: a mounting part having a first sheet and a sign member having a second sheet. The mounting part has a first edge extending from a first end to a second end of the mounting part; a second edge extending from the first end to the second end; end engaging means adjacent the first end and end engaging means adjacent the second end for engaging the first end with the second end; first sign engaging means adjacent the first edge; second sign engaging means adjacent the first edge; and one or more apertures formed in the mounting part to allow members extending horizontally from an upper end of a barrier post to extend therethrough when the mounting part is mounted on top of a barrier post.

14 Claims, 4 Drawing Sheets

(56) References Cited

U.S. PATENT DOCUMENTS

| | | | | |
|---|---|---|---|---|
| 2010/0090184 | A1* | 4/2010 | Manning | E01F 13/028 116/63 P |
| 2010/0288990 | A1* | 11/2010 | McPherson | E01F 13/028 256/65.01 |
| 2011/0107635 | A1* | 5/2011 | Walters | G09F 23/00 40/612 |
| 2012/0076970 | A1* | 3/2012 | Suter | E01F 9/654 428/80 |
| 2012/0090207 | A1* | 4/2012 | Johnston | G09F 15/0075 40/606.01 |
| 2013/0255122 | A1* | 10/2013 | Henderson | E01F 9/654 40/606.03 |
| 2016/0230357 | A1* | 8/2016 | Dia | E01F 13/028 |
| 2017/0009412 | A1* | 1/2017 | Eaton | E01F 13/028 |
| 2017/0032720 | A1* | 2/2017 | Yang | G09F 27/005 |
| 2018/0170709 | A1* | 6/2018 | Chen | E01F 13/028 |
| 2019/0063018 | A1* | 2/2019 | Reiner | B65H 75/4471 |
| 2019/0066549 | A1* | 2/2019 | Sackett | E01F 9/608 |
| 2019/0177934 | A1* | 6/2019 | Mueller | G09F 17/00 |
| 2019/0287429 | A1* | 9/2019 | Dawson | G09F 3/12 |

* cited by examiner

SIGN KIT FOR A BARRIER POST

CROSS-REFERENCE TO RELATED APPLICATION

The present application claims priority to United Kingdom Patent Application No. 2008100.6, filed May 29, 2020, the content of which is incorporated herein by reference.

BACKGROUND

Barrier posts are commonly used as part of crowd control and queue management. For example, portable or fixed barrier posts are commonly used to control queues at airports and at retail outlets. In such locations, the barrier posts have one or more barrier members extending between the posts to direct a queue. Some such barrier members are extendable from the barrier post. Alternative barrier members are ropes or other flexible members that can be removably attached to the barrier posts. Further alternative barrier members are rigid members that are permanently or removably attached to the barrier posts. Most barrier posts either have one or more barrier member extending from an upper end or one or more means for mounting barrier posts formed at an upper end.

In order to provide information to people signs are commonly mounted on top of barrier posts. For example, signs giving information on the direction of queueing, the reasons for a queue, or advertising are mounted on top of barrier posts may be provided. This can be achieved in a variety of ways. One simple way of mounting signs on top of a post is to provide a frame, within which a sign can be inserted, at the upper end of a barrier post. Such frames are commonly formed of metal and allow a suitable printed card to be inserted into and removed therefrom. The frames usually sit at the top of a mounting that is permanently or removably attached to the upper end of the barrier post. Such frames are relatively simple to use but relatively expensive and, relatively fragile. Alternative means for positioning signs on top of barrier posts are also available but these tend to be more complex and expensive. Therefore, there is a need for a simpler and cheaper apparatus for mounting signs on top of barrier posts.

SUMMARY OF INVENTION

The present invention provides a sign kit for mounting on top of a barrier post consisting of:

- a mounting part consisting of a first flexible sheet of material having:
  - a first end and a second end;
  - a first edge extending from the first end to the second end;
  - a second edge extending from the first end to the second end;
  - end engaging means provided adjacent the first end and end engaging means provided adjacent the second end for engaging the first end with the second end;
  - first sign engaging means formed adjacent the first edge;
  - second sign engaging means formed adjacent the first edge; and
  - one or more apertures are formed in the mounting part to allow members extending horizontally from an upper end of a barrier post to extend therethrough when the mounting part is mounted on top of a barrier post; and

- a sign member consisting of a second flexible sheet of material having:
  - a first end and a second end;
  - first cooperative engagement means formed adjacent the first end for engaging with the first sign engaging means of the mounting part; and
  - second cooperative engagement means formed adjacent the second end for engaging with the second sign engaging means of the mounting part; wherein:
  - the first sign engagement means and the second sign engagement means are formed such that they are on substantially opposing sides of a barrier post when the mounting part is mounted on a barrier post.

The present invention is advantageous in that it provides an extremely simple and cost effective kit for providing signs on top of barrier posts. The kit consists of only two components, each consisting of a flexible sheet of material. There is no need or requirement for further fixing or mounting means.

The kit is used in the following manner. First, the mounting part is mounted on top of a barrier post. This is done by wrapping the mounting part around the top of the barrier post such that the one or more apertures are positioned to allow members extending from the top of the barrier to extend therethrough, such that the first end engaging means can be engaged with the second engaging means to form the mounting part into a loop, and such that the first edge is the uppermost edge of the mounting part. The first end engaging means will then be engaged with the second engaging means to locate the mounting part on top of the post. Second, the sign member will be engaged with the mounting part and thereby located to extend above the top of the post. This is achieved by engaging the first cooperative engagement means of the sign member with the first sign engaging means of the mounting part, and engaging the second cooperative engagement means of the sign member with the second sign engaging means of the mounting part. This will bend the sign member over the top of the barrier post.

In embodiments of the invention the sign kit may have one or more fold lines formed between the first end and the second end to facilitate it being bent over the top of a barrier post, to engage the first cooperative engagement means of the sign member with the first sign engaging means of the mounting part, and to engage the second cooperative engagement means of the sign member with the second sign engaging means of the mounting part. Such fold lines may be formed in any manner apparent to the person skilled in the art. For example, in embodiments of the invention the sign member may have a central fold line formed midway between the first end and the second end.

The first sign engagement means and the second sign engagement means of the mounting part will be formed on the mounting part such that they are on substantially opposing sides of a barrier post when the mounting part is mounted on a barrier post. In such embodiments when the sign member is engaged with the mounting part it will extend over the upper end of the post from a first side of the post to an opposing second side of the post.

As will be readily understood, the sign member may be provided with suitable sign graphics. This can be achieved in any appropriate manner. For example, the sign member itself can be printed with the graphics. Alternatively, suitable graphics could be adhered to the sign member. As a further alternative, the sign member may be formed such that suitable graphics can be held in position by the sign member.

The sign kit can be formed of any suitable resilient and flexible material. In embodiments of the invention the mounting part and/or the sign member may be formed of a resilient polymer, for example polypropylene. One suitable polymer for forming the mounting is 470 micron polypropylene sheet. If the sign member is formed of this material then graphics can be printed directly on the sign member.

In embodiments of the invention the mounting part and/or the sign member may be formed of cardboard. Again, if the sign member is formed of cardboard then graphics can be printed directly on the sign member.

The engaging means of the present invention may be any suitable engaging means that can be formed from the flexible sheet of the mounting part of the flexible sheet of the sign member. In embodiments of the invention the engaging means may consist of male engaging means and cooperatively formed female engaging means. It will be readily apparent to the skilled person how such male and female engaging means can be formed, for example suitable female engaging means include slots formed through a flexible sheet and suitable male engaging means include tabs sized and shaped to extend through and engage with such slots.

In embodiments of the invention the sign engaging means of the mounting part are female engaging means and the cooperative engagement means of the sign member are male engaging means. Forming the mounting part and the sign member in this manner can allow the sign member to be simply slotted into position in the mounting part.

The sign member of the present invention can be any suitable shape. In embodiments of the invention the sign member may be substantially rectangular. However, it is to be understood that a multitude of other shapes are possible. For example, as shown in the Figures and as discussed below, the sign member could be trapezoidal, star-shaped, or any other suitable shape.

As will be readily understood the mounting part should have enough apertures to allow each barrier member or other protrusion at the top of the barrier post to each extend through an aperture. For example, if the barrier post has two barrier members then the mounting part may require at least two apertures, one for each barrier member to extend through. If the barrier post has four barrier members then the mounting part may require at least four apertures. In some embodiments two or more barrier members may extend through each aperture. In other embodiments a separate aperture will be provided for each barrier member.

When mounted on a barrier post, the mounting part will be supported on the top of the barrier post by the barrier members and/or other protrusions protruding through the apertures. The apertures should be appropriately shaped to allow the mounting part to be supported by the barrier members and/or other protrusions. Any aperture may extend upwards from the second edge of the mounting part, such that the apertures are effectively cutaway portions extending from the second edge of the mounting part. Alternatively, any aperture may be formed part-way between the first edge and the second edge of the mounting part and not extend to either edge. In some embodiments of the invention each aperture may be formed part-way between the first edge and the second edge.

Further features and advantages of the invention will be apparent from the embodiments shown in the Figures and described below.

FIGURES

Figure 1:
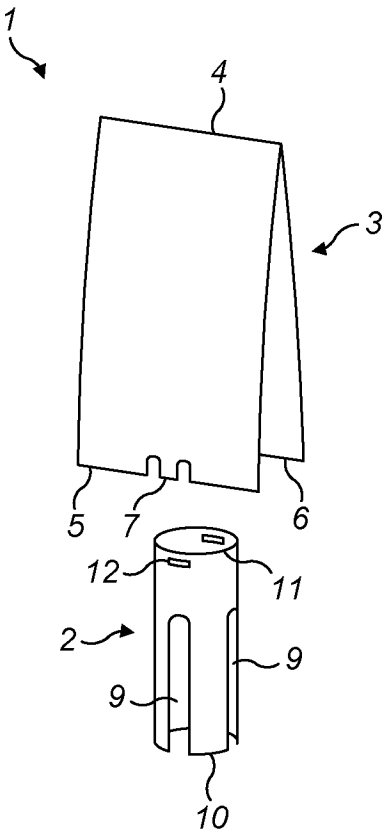
FIG. 1 shows the components of a first embodiment of a sign kit according to the present invention.

A first embodiment of a sign kit 1 according to the present invention is shown in FIG. 1. The sign kit 1 consists of a mounting part 2 and sign member 3. The mounting part 2 and the sign member 3 are each formed of a single sheet of polypropylene.

The sign member 3 consists of a substantially rectangular sheet of polypropylene having a central fold line 4 formed between a first end 5 and a second end 6. A first mounting tab 7 is formed at the first end 5 and a second mounting tab 8 (not shown) is formed at the second end 6. The sign member 3 is folded along the central fold line 4 to form an inverted V-shape.

The mounting part 2 consists of a sheet of polypropylene that has been rolled to form a tube. A first end of the mounting part 2 is engaged with the second end of the mounting part by means of engaging means (not shown) to hold the mounting part 2 in the tubular shape. The mounting part 2 has four apertures 9 formed therethrough. The apertures 9 are equally spaced around the mounting part 2 and extend upwards from a lower edge 10 of the mounting part. An upper edge 11 of the mounting part is straight and continuous. Two slots 12 for engaging with the first and second mounting tabs 7, 8 of the sign member 3 are formed adjacent the upper edge of the mounting part 2.

Figure 2:
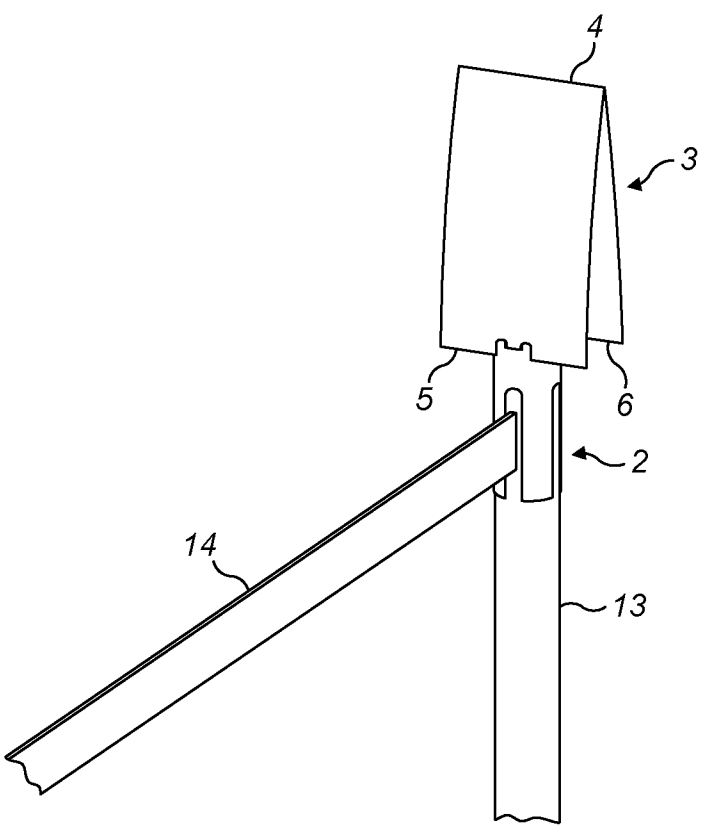
FIG. 2 show the sign kit of FIG. 1 positioned on top of a barrier post.

The sign kit 1 of FIG. 1 is shown mounted on a barrier post 13 in FIG. 2. The barrier post 13 has an extendable tape 14, forming a barrier member, extending from an upper end. The mounting part 2 is mounted on top of the barrier post 13 with the extendable tape 14 extending through an aperture 9 of the mounting part. The sign member 3 is mounted on the mounting part 2 by engaging the each of the first and second mounting tabs 7, 8 through a slot 12 of the mounting part 2. In this manner the sign member 3 is positioned on top of the barrier post 13 and can act to provide appropriate signage to users. For example, a suitable graphic could be printed directly onto the sign member 3.

Figure 4:
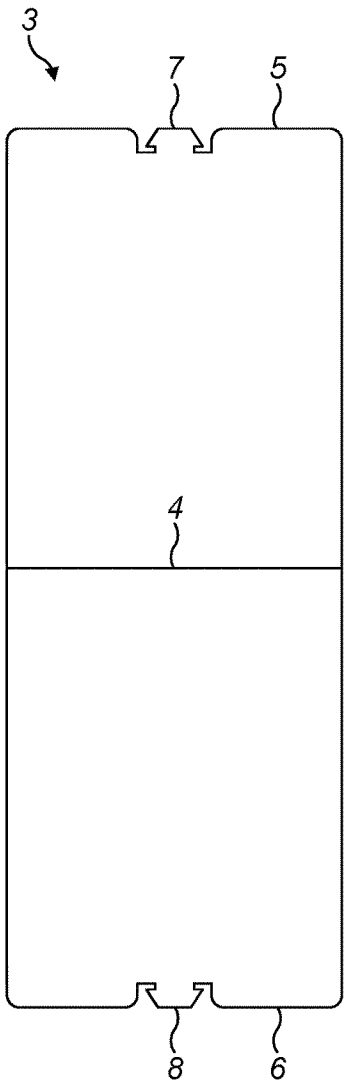
FIG. 4 shows the sign member of the sign kit of FIG. 3.
Figure 3:
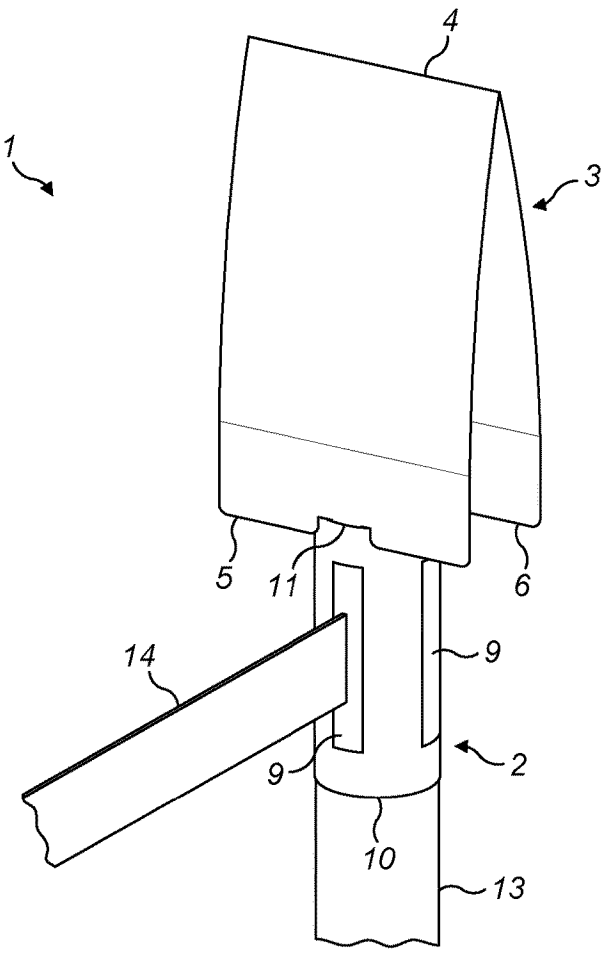
FIG. 3 shows a second embodiment of a sign kit according to the present invention.
Figure 5:
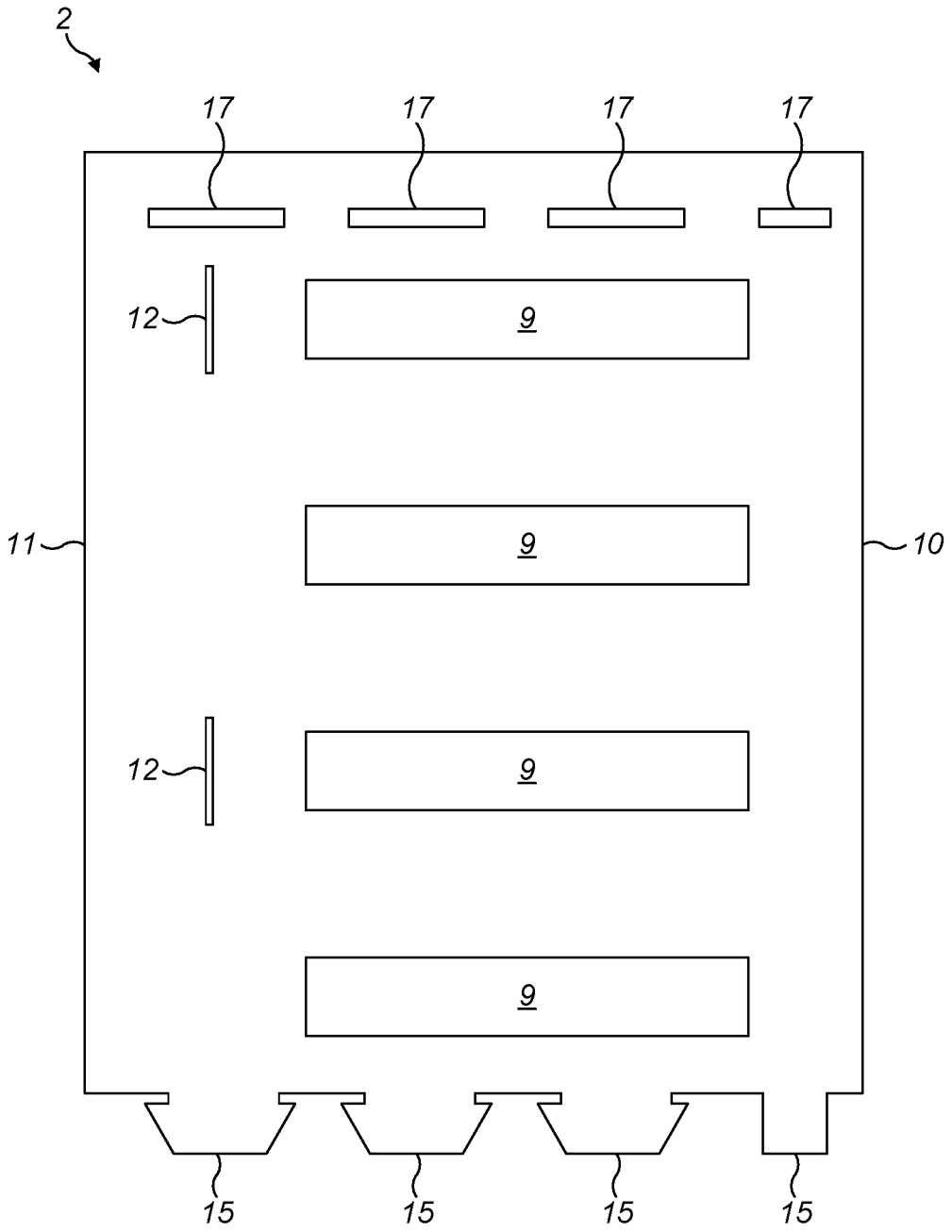
FIG. 5 shows the mounting part of the sign kit of FIG. 3.

A second embodiment of a sign kit 1 according to the present invention is shown in FIGS. 3 to 5. The second embodiment of the sign kit 1 is largely similar to the first embodiment and has all of the same features. Therefore, the same reference numerals have been used to refer the same features.

The second embodiment of the sign kit 1 differs from the first embodiment only in that the apertures 9 do not extend from the lower edge 10 of the mounting part 2. Instead, the apertures 9 are formed part way between the upper edge 11 and the lower edge and do not extend to either. This can ensure that the sign kit 1 is more securely mounted on a barrier post 13 and cannot simply be lifted off the post.

The sign member 3 of the first and second embodiments of the sign kit 1 is shown in FIG. 4. This FIG. 4 clearly shows the first and second mounting tabs 7, 8 of the sign member 3 that allow it to engage with and be supported by the mounting part 2. This FIG. 4 also clearly shows how the sign member 3 is formed from a single sheet of flexible polypropylene.

The mounting part 2 of the second embodiment of the sign kit 1 is shown in FIG. 5. This shows the mounting part 2 as a flat sheet of flexible polymer and also clearly shows the two slots 12 the upper edge 11 for mounting the sign member 2. This Figure also clearly shows the apertures 9 formed partway between the upper edge 11 and the lower edge 10. Finally, this Figure shows the engaging means for forming the mounting part 2 into a cylinder. These engaging means comprises four tabs 15 at a first end 16 of the mounting part 2 and four cooperatively formed slots 17 formed adjacent a second end 17 of the mounting part. As will be readily understood, when in use the tabs 15 will be inserted into the slots 17 to form the mounting part into a cylinder.

Figure 6:
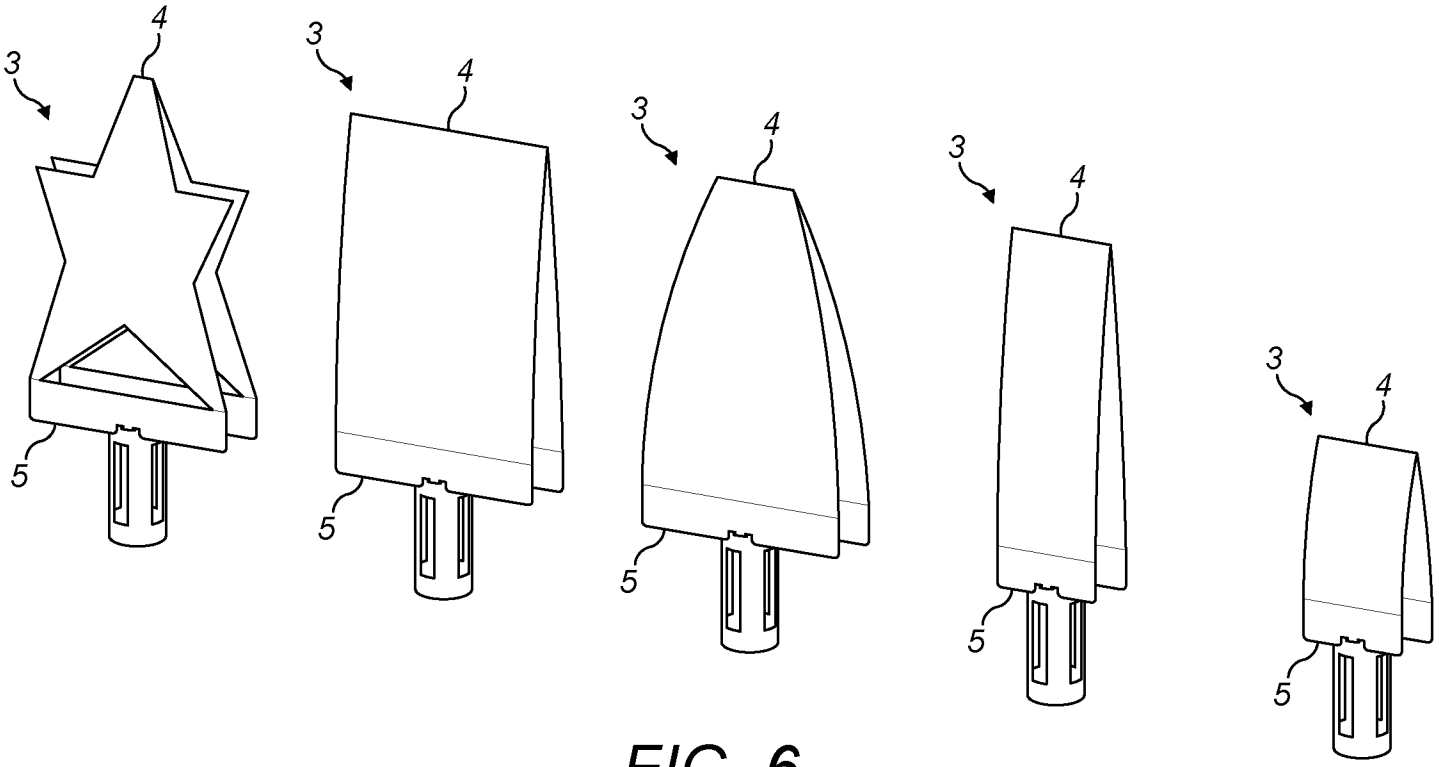
FIG. 6 shows various alternative embodiments of a sign kit according to the present invention.

FIG. 6 shows alternative embodiments of the sign member 3 of the sign kit of the present invention. In particular, FIG. 6 shows how the sign member 3 may be any shape and shape that allows it to have a central fold line 4, and mounting tabs 7, 8 at the first and second ends 5, 6. In particular, the sign members 3 may have differing heights, widths, and even shapes. For example, whilst many sign members may be substantially rectangular for simplicity, as shown in FIG. 6, it is also possible for the sign member 3 to be star shaped, have a tapered shape. As the skilled person will understand many other shapes are also possible.

The invention claimed is:

1. A sign kit for mounting on top of a barrier post consisting of:

a mounting part consisting of a first flexible sheet of material having:

a first end and a second end;

a first edge extending from the first end to the second end;

a second edge extending from the first end to the second end;

end engaging means provided adjacent the first end and end engaging means provided adjacent the second end for engaging the first end with the second end;

first sign engaging means formed adjacent the first edge;

second sign engaging means formed adjacent the first edge; and one or more apertures are formed in the mounting part to allow members extending horizontally from an upper end of a barrier post to extend therethrough when the mounting part is mounted on top of a barrier post; and a sign member consisting of a second flexible sheet of material having:

a first end and a second end;

first cooperative engagement means formed adjacent the first end for engaging with the first sign engaging means of the mounting part; and second cooperative engagement means formed adjacent the second end for engaging with the second sign engaging means of the mounting part.

2. The sign kit according to claim 1, wherein the sign member has one or more fold lines formed between the first end and the second end.

3. The sign kit according to claim 2, wherein the sign member has a central fold line formed midway between the first end and the second end.

4. The sign kit according to claim 1, wherein the mounting part and/or the sign member are formed of a resilient polymer.

5. The sign kit according to claim 4, wherein the mounting part and/or the sign member are formed of polypropylene.

6. The sign kit according to claim 1, wherein the mounting part and/or the sign member are formed of cardboard.

7. The sign kit according to claim 1, wherein the end engaging means may comprise a male engaging means and cooperatively formed female engagement means, and/or the first sign engaging means and the first cooperative engagement means may consist of a male engaging means and cooperatively formed female engagement means, and/or the second sign engaging means and the second cooperative engagement means may consist of male engaging means and cooperatively formed female engagement means.

8. The sign kit according to claim 7, wherein the female engaging means are slots formed through the mounting part or sign member and the male engaging means are tabs formed to extend through and engage with the slots.

9. The sign kit according to claim 7, wherein the sign engaging means of the mounting part are female engaging means and the cooperative engagement means of the sign member are male engaging means.

10. The sign kit according to claim 1, wherein the sign member is substantially rectangular.

11. The sign kit according to claim 1, wherein the mounting part has two apertures.

12. The sign kit according to claim 1, wherein the mounting part has four apertures.

13. The sign kit according to claim 1, wherein the apertures of the mounting part extend to the second edge of the mounting part.

14. The sign kit according to claim 1, wherein the apertures of the mounting part are formed part-way between the first edge and the second edge.

* * * * *